United States Patent [19]

Shimoie

[11] Patent Number: 4,986,075

[45] Date of Patent: Jan. 22, 1991

[54] HYDRAULIC CIRCUIT FOR BACKHOE

[75] Inventor: Shizuo Shimoie, Saikai, Japan

[73] Assignee: Kubota, Ltd., Osaka, Japan

[21] Appl. No.: 347,730

[22] Filed: May 5, 1989

[30] Foreign Application Priority Data

Jul. 26, 1988 [JP] Japan ..... 63-187872
Jul. 27, 1988 [JP] Japan ..... 63-99539[U]

[51] Int. Cl.[5] ..... F16D 31/02

[52] U.S. Cl. ..... 60/468; 60/484; 60/494

[58] Field of Search ..... 60/468, 428, 494, 484

[56] References Cited

U.S. PATENT DOCUMENTS 4,017,221 4/1977 Dezelan ..... 60/494
4,218,886 8/1980 White ..... 60/494 X
4,345,436 8/1982 Johnson ..... 60/428 X
4,467,604 8/1984 Forster ..... 60/484
4,531,366 7/1985 Moriya et al. ..... 60/428 X

*Primary Examiner*—William E. Wayner
*Attorney, Agent, or Firm*—Gifford, Groh, Sprinkle, Patmore and Anderson

[57] ABSTRACT

In a hydraulic circuit for a backhoe vehicle including a plurality of hydraulic pumps and operating valves for a pair of right and left vehicle-propelling devices and other work implements, two hydraulic circuits connected to the vehicle-propelling devices share a single unit of relief circuit adapted for selectively providing relief oil pressure in a plurality of steps. In a vehicle propelling operation or an excavating operation, the relief circuit provides a higher relief pressure to oil passages used in this operation than that provided for an all-pump-activated condition, hence, the engine output may be harnessed more efficiently.

7 Claims, 5 Drawing Sheets

HYDRAULIC CIRCUIT FOR BACKHOE

BACKGROUND OF THE INVENTION

1. Field of the Invention

The present invention relates to a hydraulic circuit for a backhoe vehicle: comprising; a first hydraulic pump, a second hydraulic pump and a third hydraulic pump all driven by a same engine; a pair of right and left vehicle propelling operating valves, with one of the valve pair and an arm operating valve being connected with the first hydraulic pump via a first oil feed passage, the other of the valve pair, a boom operating valve and a bucket operating valve being connected with the second hydraulic pump via a second oil feed passage; and a swivel operating valve connected with the third hydraulic pump.

2. Description of the Prior Art

A backhoe vehicle of the above-described type is known e.g. from a Japanese utility model laid open under Showa 62-31166, in which the relief pressure acting on the oil feed passage extending from the first hydraulic pump and the oil feed passage extending from the second hydraulic pump is fixedly maintained.

However, the above prior art fails to fully utilize the engine power for propelling of vehicle or excavating operation. More particularly, in the above prior backhoe vehicle, considering a situation in which an actuator connected with the first hydraulic pump, an actuator connected with the second hydraulic pump and an actuator connected with the third hydraulic pump are driven at the same time, the engine power is so set as to prevent construction of an engine stop even when the oil feed pressures from all of the first through third hydraulic pumps have reached the relief pressure. In a vehicle propelling or excavating operation, the oil fed from the first and second hydraulic pumps is used for driving the actuators and thus the engine need provide a large load for driving the first and second hydraulic pumps while no such large load is required from the engine for driving the third hydraulic pump. For this reason, the total engine load tends to be smaller than the allowable maximum value. That is to say, the engine power is not fully utilized in the vehicle propelling or excavating operation.

The primary object of the present invention is to provide a construction which makes it possible to make most of the engine power even when the actuators are driven solely by the first and second hydraulic pumps and also to form the construction very simple and easy to assemble.

SUMMARY OF THE INVENTION

According to the characterizing features of the present invention, in a hydraulic construction for a backhoe vehicle of the above-noted type, the first oil feed passage and the second oil feed passage are connected with a same relief oil passage, the relief oil passage including a high-pressure relief valve, a low-pressure relief valve and a switch valve for switching over a relief pressure of the relief oil passage between a high pressure provided by the high-pressure relief valve and a low pressure provided by the low-pressure relief valve. Functions and effects of this construction will be described next.

Unlike the convention in which the first oil feed passage and the second oil feed passage are connected respectively with separate relief oil passages, the above construction of the invention makes it possible to vary the relief pressure for the pressure oils fed from the first and second hydraulic pumps while reducing the number of the relief oil passages required. Further, when the actuators are driven solely by the first and second hydraulic pumps, if the relief pressure is adjustably increased for the high-pressure side, the engine of which maxium power is so set as sufficient for permitting all the pumps to drive the actuators may drive the first and second hydraulic pumps with a power greater than that provided to the same when the engine drives all the pumps. Consequently, the first and second hydraulic pumps may drive the actuators powerfully by feeding the same with the oils having a higher pressure than that applied in the all-pump driving condition.

Further, since the relief pressure is variable, the engine output may be efficiently utilized not only in actuator driving operation by all of the hydraulic pumps but also in a vehicle propelling operation and an excavating operation. Also, since the actuators are driven powerfully by the engine, the vehicle may travel on an uphill or carry out an excavating operation more effectively.

Moreover, since the relief construction for the first hydraulic pump is co-utilized as that for the second hydraulic pump, the entire construction may be formed simple.

According to one preferred embodiment of the present invention, the relief oil passage is formed by an oil-passage-forming block incorporating the high-pressure relief valve, the low-pressure relief valve and the switch valve. With this feature of the invention, in forming the various operating valves as a multiple valve construction, the valve group forming the multiple valve construction may be assembled integrally with the oil-passage-forming block. Further, if the oil-passage-forming block is so constructed that the relief oil passage is communicated with the first oil feed passage, second oil feed passage and the oil exhaust passage of the valve group when the block is assembled, the assembly of the relief valve and the switch valve may be carried out at one time.

Consequently, since the assembly of the oil passages and switch valve for the relief construction may be effected at one time only with the assembly of the oil-passage-forming block, the assembly operation of the entire construction has become facilitated and cost reduction has become possible because of the simple construction and assembly.

BRIEF DESCRIPTION OF THE DRAWINGS

Accompanying drawings illustrate preferred embodiments of a hydraulic circuit of a backhoe vehicle related to the present invention; in which.

DESCRIPTION OF THE PREFERRED EMBODIMENTS

Preferred embodiments of the present invention will be particularly described next.

Figure 1:
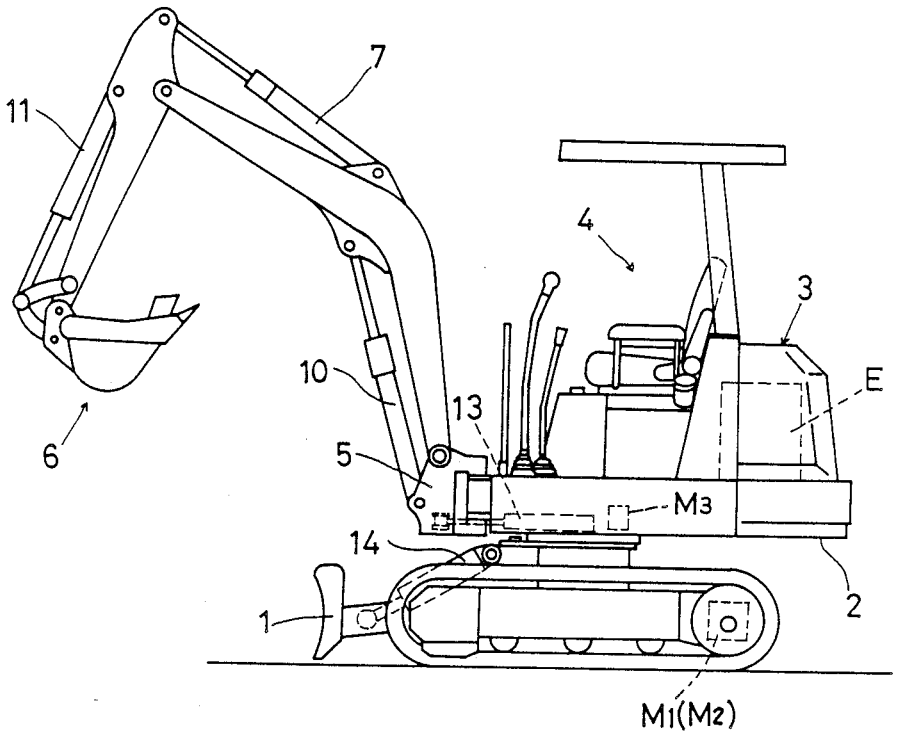
FIG. 1 is a side view showing an entire dozer-equipped backhoe vehicle.

As shown in FIG. 1, a dozer-equipped backhoe vehicle includes a crawler-propelling type vehicle body equipped with a dozer plate 1, a swivel table 2 attached to the vehicle body, with the swivel table 2 having an engine unit 3, a driver's cabin 4 and a backhoe device 6 attached to the swivel table to be pivotable relative thereto via a swing bracket 5.

Figure 2:
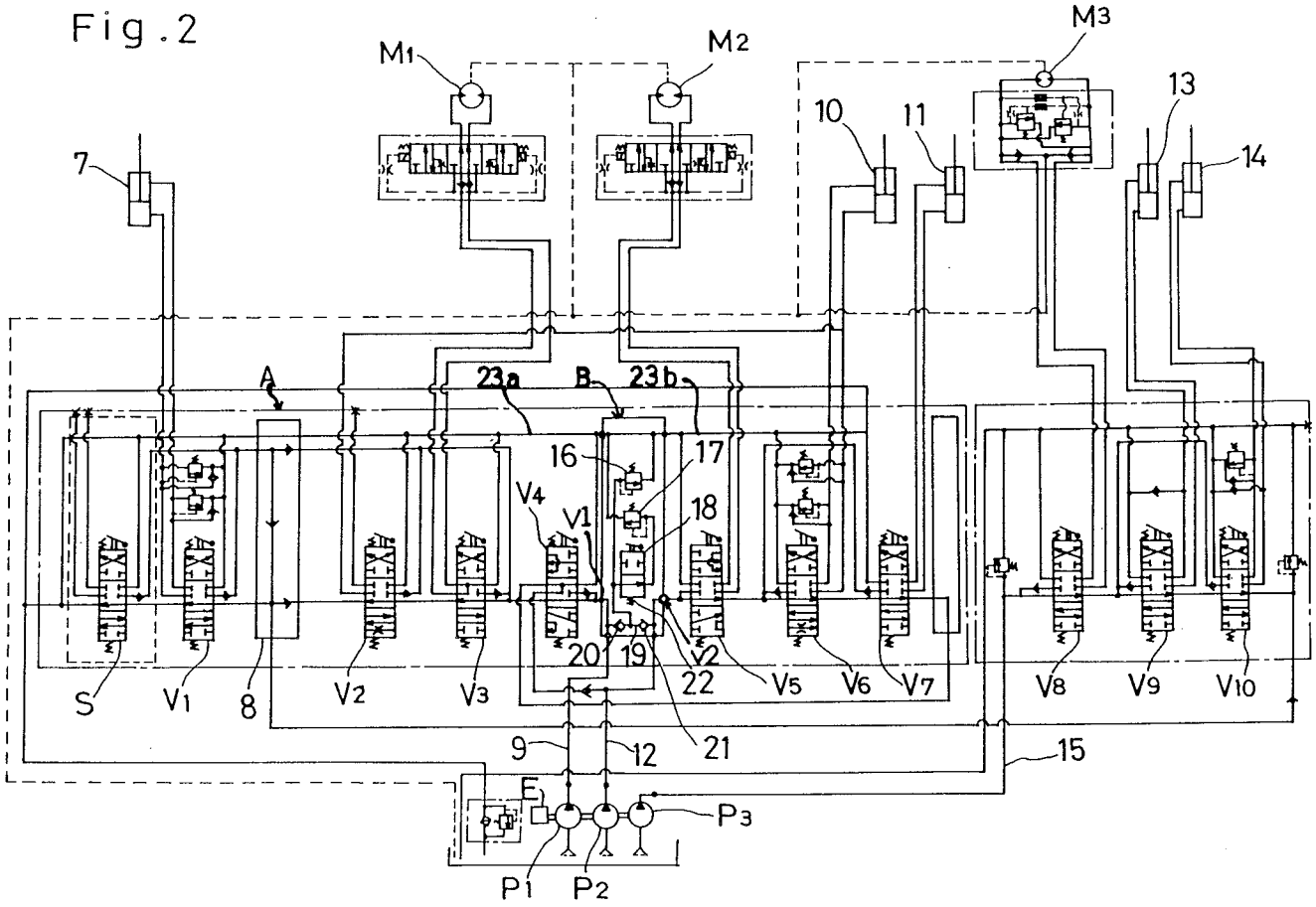
FIG. 2 is a diagram of a hydraulic circuit related to the present invention.

For operating the dozer plate 1, swivel table 2, propelling device and the backhoe device 6, there are provided first through third hydraulic pumps P1, P2 and P3 driven by a single engine E, and there is also provided a hydraulic circuit which construction will be described next with reference to FIG. 2.

That is, in the hydraulic circuit, there is provided a center-bypass type multiple valve construction including a service port operating valve S, an arm operating valve V1 for an arm cylinder 7, a converging spacer 8, a converging valve V2 of a boom, an operating valve V3 for one of right and left vehicle propelling motors M1 and M2 and a converging valve V4, with the valve construction being connected with a first hydraulic pump P1 via a first oil feed passage 9. Also, there is provided a further center-bypass type multiple valve construction including an operating valve V5 for the other of the right and left vehicle propelling motors M1 and M2, a boom operating valve V6 for a boom cylinder 10, a bucket operating valve V7 for a bucket cylinder 11, with the further valve construction being connected with a second hydraulic pump P2 via a second oil feed passage 12. Further, there is provided another center-bypass type multiple valve construction including an swivel operating valve V8 for a swivel motor M3, a swing operating valve V9 for a swing cylinder 13 and a dozer operating valve V10 for a dozer cylinder 14, with the valve construction being connected with a third hydraulic pump P3 via a third oil feed passage 15.

The vehicle propelling operating valves V3 and V5 are switched over by a pair of separate operating levers (not shown). The boom operating valve V6 and the bucket operating valve V7 are switched over by a single operating lever (not shown). The swivel operating valve V8 and the swing operating valve V9 are selectively operated by a single operating lever (not shown). The arm operating valve V1 and the swivel operating valve V8 or the arm operating valve V1 and the swing operating valve V9 are switched over by a cross-pivotable operating lever (not shown).

A relief oil passage 19 includes a high-pressure relief valve 16, a low-pressure relief valve 17 and a pair of check valves 20 and 21, and is connected with the first oil passage 9 and the second oil passage 12 such that the one check valve 20 checks a reverse flow into the first oil feed passage 9 and the other check valve 21 checks a reverse flow into the second oil feed passage 12. In operation, when the switch valve 18 is opened by an urging spring 22, the low-pressure relief valve 17 becomes connected with the check valves 20 and 21 and acts, while overriding the high-pressure relief valve 16, to provide a low relief pressure in the relief oil passage 19. The switch valve 18 is shown in the open position in FIG. 3. On the other hand, when the switch valve 18 is closed by a manual switchover operation, the low-pressure relief valve 17 becomes disconnected from the check valves 20 and 21, while the high-pressure relief valve 16 remains connected with the check valves 20 and 21, whereby the high-pressure relief valve 16 provides a high relief pressure in the relief oil passage 19.

That is to say, when all of the first through third hydraulic pumps P1, P2 and P3 are activated for driving the actuators, the relief pressure applied to the oil fed from the first hydraulic pump P1 and the second hydraulic pump P2 is adjusted at the low pressure provided by the low-pressure relief valve 17, such that the engine will not stop even if the pressure of oil provided by all of the hydraulic pumps P1 through P3 reaches the relief pressure. On the other hand, in the case of vehicle propelling or excavating operation in which the actuators are driven only by the first hydraulic pump P1 and the second hydraulic pump P2, with a switchover operation of the switch valve 18, the relief pressure applied to the oil fed from the first hydraulic pump P1 and the second hydraulic pump P2 is adjusted at the high pressure provided by the high-pressure relief valve 16, such that the output of the engine E may be fully utilized for driving the first and second hydaulic pumps P1 and P2. Consequently, the first and second hydraulic pumps P1 and P2 may feed oil with increased pressure thereby enhancing the power of the motors M1 and M2 and of the cylinders 10 and 11.

Figure 3:
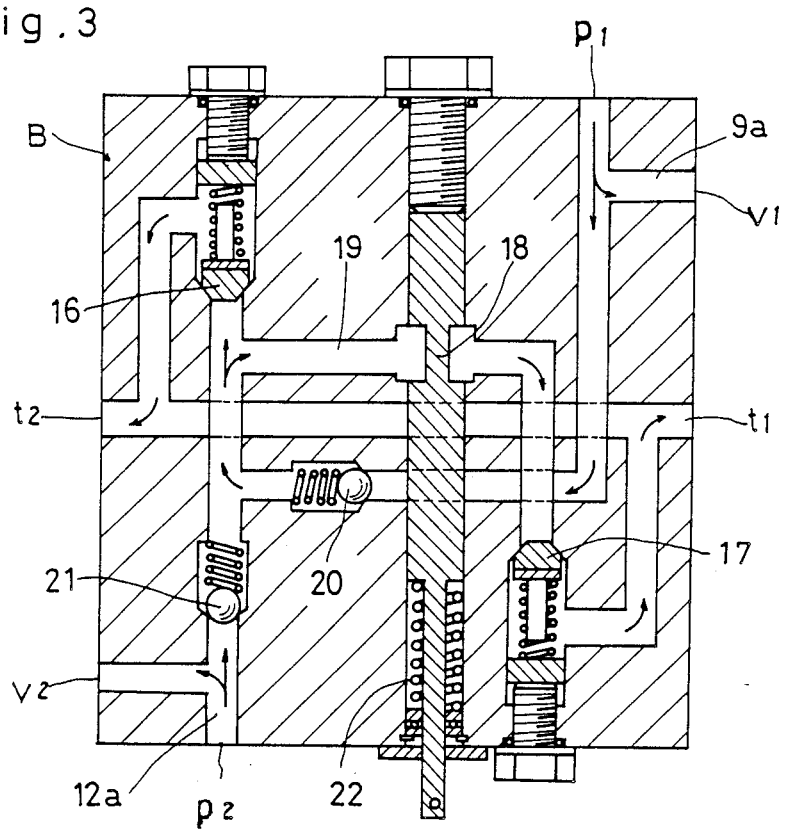
FIG. 3 is a developed sectional view of an oil-passage-forming block.
Figure 4:
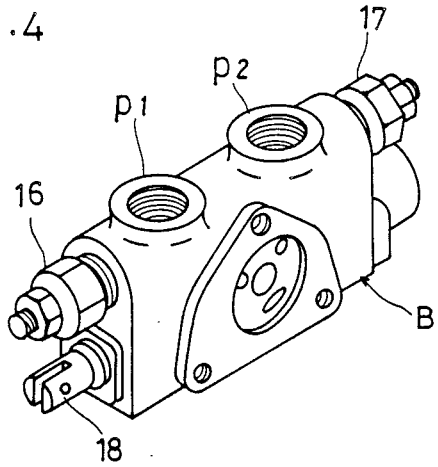
FIG. 4 is a perspective view of the oil-passage-forming block.

As shown in FIGS. 3 and 4, a portion 9*a* of the first oil feed passage 9, a portion 12*a* of the second oil feed passage 12 and the relief oil passage 19 are formed by defining oil-passage-forming holes in an oil-passage-forming block B. And, the check valves 20 and 21, the high-pressure relief valve 16, the low-pressure relief valve 17, the switch valve 18 and the urging spring 22 are held in attaching holes of defined in the oil-passage-forming block B. The oil-passage-forming block B is so configurated as to allow attachment of a valve group A consisting of the multiple valve constructions of the valve S and the valves V1 through V7. When this block is assembled, the first oil feed passage portion 9*a* becomes connected with the pump side via a pump port p1 and connected with the operating valve side via a valve port v1; the second oil feed passage portion 12*a* becomes connected with the pump side via a pump port p2 and connected with the operating valve side via a valve port v2; and the relief oil passage 19 becomes connected with oil exhaust passages 23*a* and 23*b* of the valve group A via a pair of tank ports t1 and t2. That is, merely by attaching the oil-passage-forming block B to the valve group A, the relief oil passage 19, the relief valves 16 and 17 and the switch valve 18 may be assembled together.

Alternate Embodiments

Figure 5:
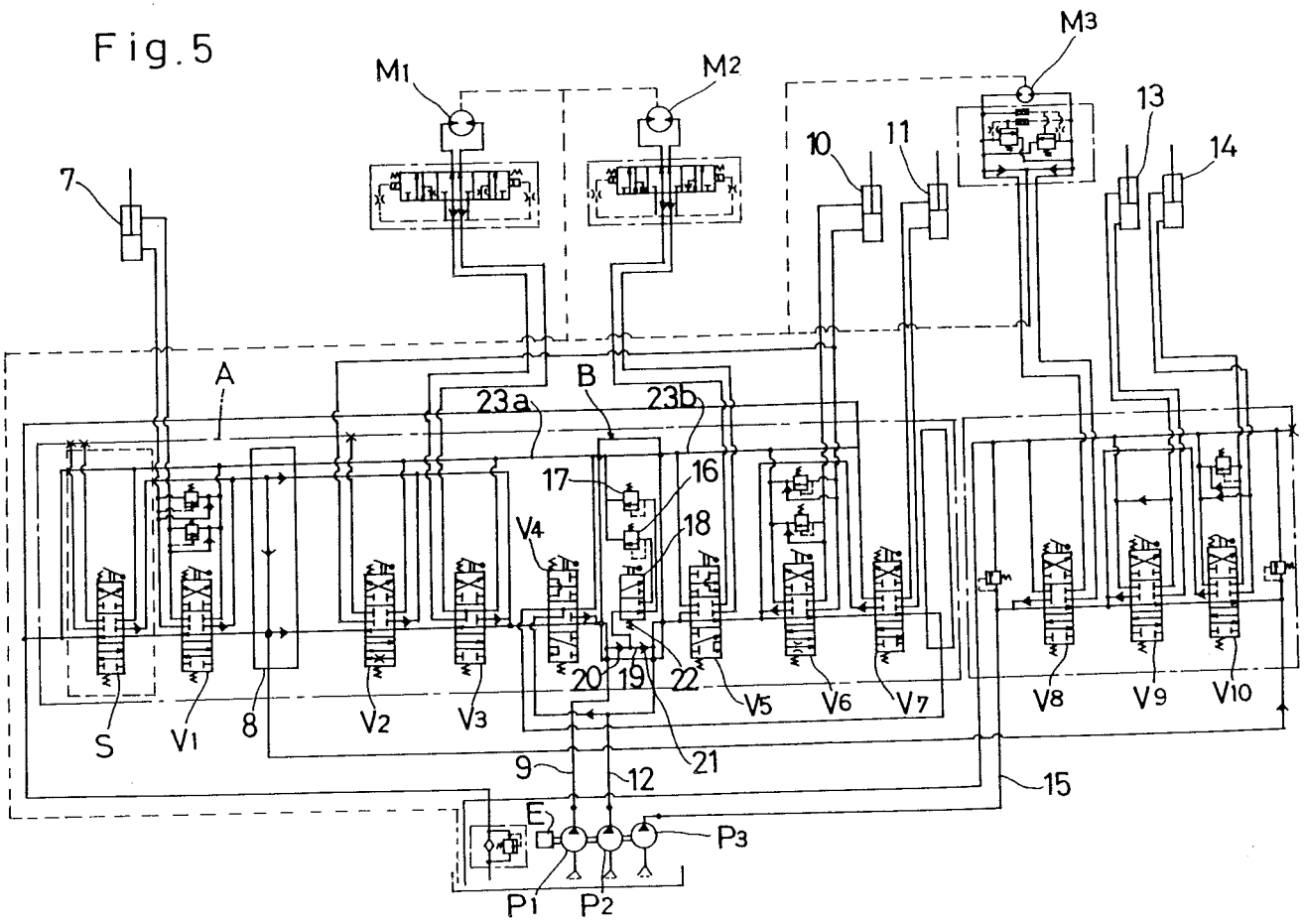
FIGS. 5 and 6 are diagrams of hydraulic circuits of alternate embodiments of the invention.
Figure 6:
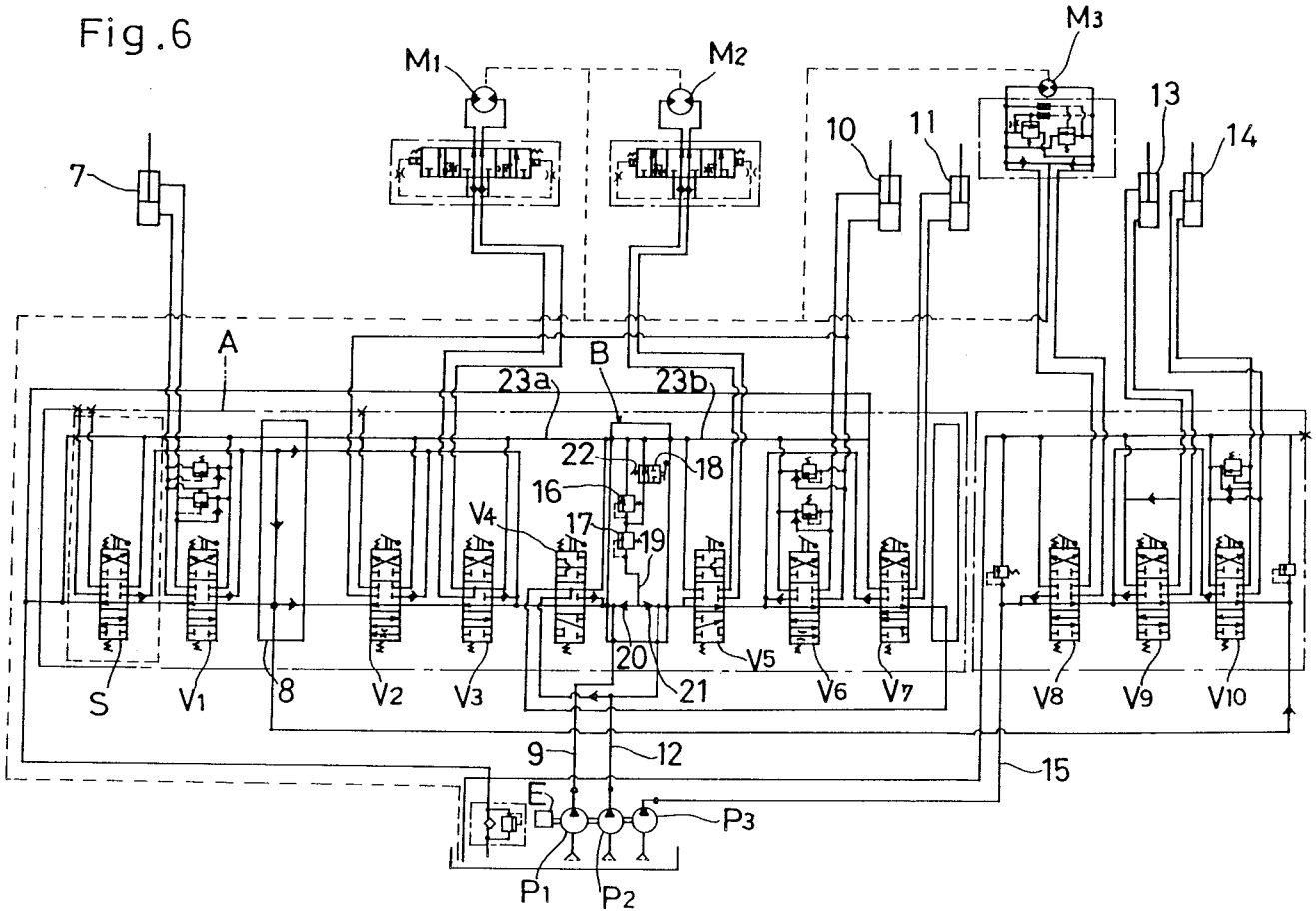

FIGS. 5 and 6 show alternate embodiments of the relief oil passage 19. In the construction of FIG. 5, the switch valve 18 is constructed as a flow-passage switch valve. In operation, when this switch valve 18 is operated at one position by the urging spring 22, the low-pressure relief valve 17 becomes connected with the check valves 20 and 21, whereby the low-pressure relief valve 17 provides a low relief pressure in the relief oil passage 19. On the other hand, when the switch valve 18 is manually operated into the other position, the high-pressure relief valve 16 becomes connected with the check valves 20 and 21, whereby the high-pressure relief valve 16 provides a high relief pressure in the relief oil passage 19.

In the construction of FIG. 16, the switch valve 18 is constructed as an opening/closing valve. That is, when this opening/closing valve 18 is opened by the urging spring 22, there is established an oil passage in which the oil from the low-pressure relief valve 17 bypasses the high-pressure relief valve 16 and returns directly to the tank, whereby the low-pressure relief valve 17 provides a low relief pressure in the relief passage 19. On the other hand, when the opening/closing valve 18 is switched over to its closed position, there is established only a single oil passage in which the oil from the low-pressure relief valve 17 passes through the high-pressure relief valve 16 to return to the tank, whereby the high-pressure relief valve 16 provides a high relief pressure in the relief oil passage 19.

Further, the above embodiments employ only one pair of the high-pressure relief valve 16 and the low-pressure relief valve 17 in order to provide the two steps of high and low relief pressures. Instead, the relief oil circuit may include more than two relief valves for providing more than two steps of oil pressures.

Incidentally, although reference marks are provided in the appended claims for the purpose of facilitating reference to the accompanying drawings, it is to be understood that the provision of these marks are not to limit the scope of the invention to the constructions illustrated in these drawings.

What is claimed is:

1. A hydraulic circuit for a backhoe vehicle: comprising;

a first hydraulic pump (P1), a second hydraulic pump (P2) and a third hydraulic pump (P3) all driven by a same engine (E);

a pair of right and left vehicle propelling operating valves (V3) and (V5), with one valve (V3) or (V5) and an arm operating valve (V1) being connected with said first hydraulic pump (P1) via a first oil feed passage (9), with the other valve (V3) or (V5), a boom operating valve (V6) and a bucket operating valve (V7) being connected with said second hydraulic pump (P2) via a second oil feed passage (12); and a swivel operating valve (V8) connected with said third hydraulic pump (P3);

wherein said first oil feed passage (9) and said second oil feed passage (12) are connected with a same relief oil passage (19), said relief oil passage (19) including a high-pressure relief valve (16), a low-pressure relief valve (17) and a switch valve (18) for switching over a relief pressure of said relief oil passage (19) between a high pressure provided by said high-pressure relief valve (16) and a low pressure provided by said low-pressure relief valve (17).

2. A hydraulic circuit for a backhoe vehicle as claimed in claim 1, wherein said relief oil passage (19) is formed by an oil-passage-forming block (B) incorporating said high-pressure relief valve (16), said low-pressure relief valve (17) and said switch valve (18).

3. A hydraulic circuit for a backhoe vehicle as claimed in claim 1, wherein said relief oil passage (19) is directly connected with said high-pressure relief valve (16), and said switch valve (18) is an opening/closing valve for selectively connecting said relief oil passage (19) to said low-pressure relief valve (17).

4. A hydraulic circuit for a backhoe vehicle as claimed in claim 1, wherein said switch valve (18) is a flow-passage switch valve for selectively connecting said relief oil passage (19) to said low-pressure and high-pressure relief valves (17) and (16).

5. A hydraulic circuit for a backhoe vehicle as claimed in claim 1, wherein said low-pressure relief valve (17) and said high-pressure relief valve (16) are connected in series in this order from the inflow side of said relief oil passage (19), and said switch valve (18) comprises an opening/closing valve for opening/closing a bypass passage extending from a connecting passage between said relief valves (17) and (16) to a return oil passage.

6. A hydraulic circuit for a backhoe vehicle as claimed in claim 1, wherein said relief oil passage (19) includes a pair of check valves (20) and (21) for said first oil feed passage (9) and said second oil feed passage (12), respectively.

7. A hydraulic circuit for a backhoe vehicle: comprising;

a first hydraulic pump (P1), a second hydraulic pump (P2) and a third hydraulic pump (P3) all driven by a same engine (E);

a pair of right and left vehicle propelling operating valves (V3) and (V5), with one valve (V3) or (V5) and an arm operating valve (V1) being connected with said first hydraulic pump (P1) via a first oil feed passage (9), with the other valve (V3) or (V5), a boom operating valve (V6) and a bucket operating valve (V7) being connected with said second hydraulic pump (P2) via a second oil feed passage (12); and a swivel operating valve (V8) connected with said third hydraulic pump (P3);

wherein said first oil feed passage (9) and said second oil feed passage (12) are connected with a same relief oil passage (19), said relief oil passage (19) including a group of relief valves and a group of swtich valves, thereby selectively providing a plurality of steps of relief oil pressures.

* * * * *